US005607346A

United States Patent [19]

Wilson et al.

[11] Patent Number: 5,607,346

[45] Date of Patent: Mar. 4, 1997

[54] POLISHING TOOL COMPONENT

[76] Inventors: Stuart M. Wilson, Tangmere, 192 Hurricane Way, Woodley, Berkshire; John S. Sexton, Bobcat, West Street, Odiham, Hampshire; Derek N. Wright, 5 Eagle Close, Heathlake, Crowthorne, Bershire, all of England

[21] Appl. No.: 367,301

[22] PCT Filed: May 13, 1994

[86] PCT No.: PCT/GB94/01034

§ 371 Date: Jan. 11, 1995

§ 102(e) Date: Jan. 11, 1995

[87] PCT Pub. No.: WO94/26470

PCT Pub. Date: Nov. 24, 1994

[30] Foreign Application Priority Data

May 14, 1993 [GB] United Kingdom ..... 9309972

[51] Int. Cl.[6] ..... B23F 21/03

[52] U.S. Cl. ..... 451/540; 451/548

[58] Field of Search ..... 451/540, 542, 451/543, 548

[56] References Cited

U.S. PATENT DOCUMENTS

| | | | |
|---|---|---|---|
| 1,290,990 | 1/1919 | Hickey | 451/548 |
| 1,953,983 | 4/1934 | Benner | 451/548 X |
| 2,000,772 | 5/1935 | McGill | 451/542 |
| 2,145,888 | 2/1939 | Moulton et al. | 451/548 |
| 2,225,193 | 12/1940 | Benner et al. | 451/548 X |
| 3,343,308 | 9/1967 | Fessel | 451/542 |
| 4,041,650 | 8/1977 | Sawluk | 451/548 X |
| 4,457,765 | 7/1984 | Wilson | 451/548 X |

FOREIGN PATENT DOCUMENTS

| | | | |
|---|---|---|---|
| 894614 | 12/1944 | France | 451/548 |
| 1533693 | 7/1968 | France . | |
| 2532875 | 9/1982 | France . | |
| 2601788 | 7/1977 | Germany . | |
| 8706303 | 6/1987 | Germany . | |
| WO89/01843 | 3/1989 | WIPO . | |

OTHER PUBLICATIONS

Patent Abstracts of Japan, vol. 9, No. 7 (M–350) (1730) Jan. 12, 1985 & JP A 59–156669.

*Primary Examiner*—Timothy V. Eley
*Attorney, Agent, or Firm*—Scully, Scott Murphy and Presser

[57] ABSTRACT

A polishing tool component comprises a carrier and a plurality of spaced abrasive elements located in a surface of the carrier. Each abrasive element presents a working surface having a perimeter which is circular, polygon or of like non-elongate shape, and comprises a mass of abrasive particles such as diamond or cubic boron nitride uniformly dispersed in a bonding matrix. The bonding matrix may be metal, ceramic or polymeric. The working surfaces of the elements together define a working surface for the component. The working surfaces may be located in the surface in which the elements are located, or project beyond that surface.

15 Claims, 2 Drawing Sheets

FIG 1
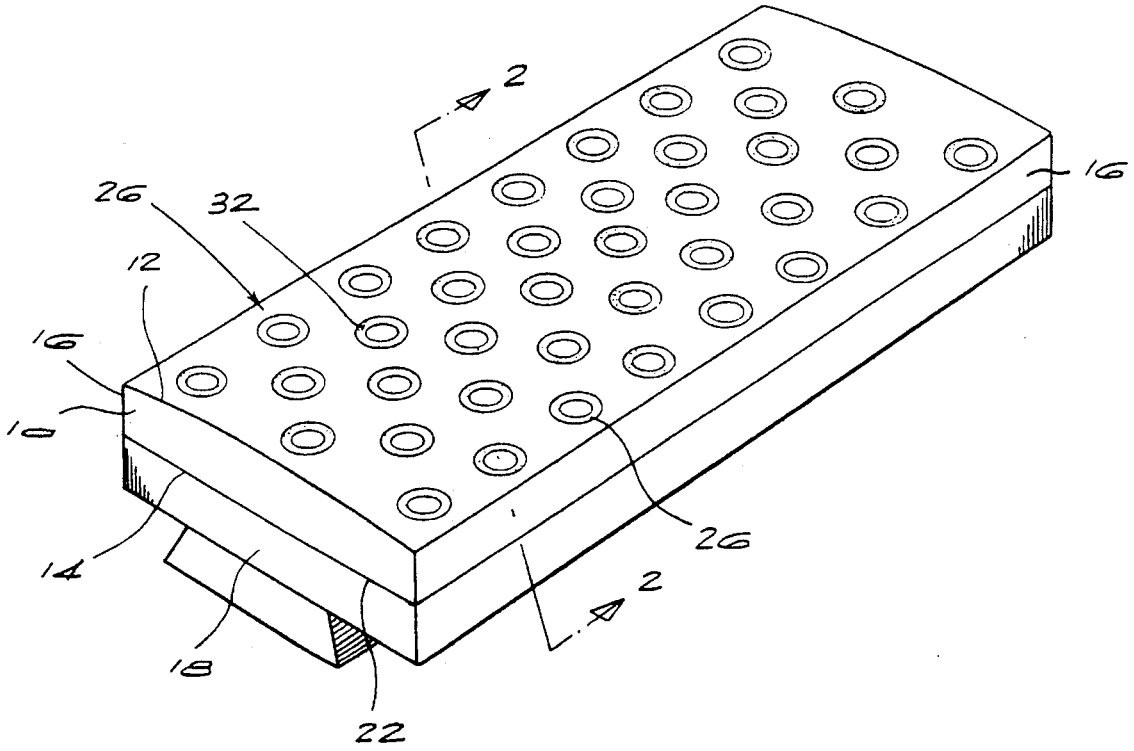
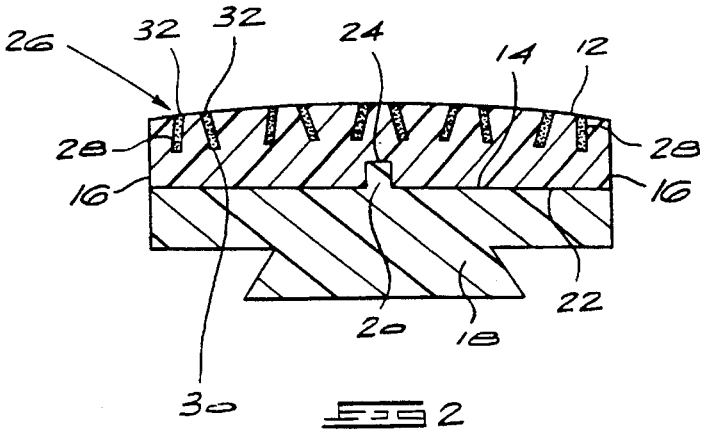
FIG 2

POLISHING TOOL COMPONENT

BACKGROUND OF THE INVENTION

This invention relates to a polishing tool component.

Polishing pads are used extensively in industry for fine finishing or polishing various workpieces, which are typically stone or ceramic in nature. Such polishing pads consist of a carrier having a layer of abrasive particles suitably secured to a surface thereof. The abrasive particles may be secured to the surface of the carrier by means of metal or resin binders.

French Patent No. 2532875 discloses a grinding wheel comprising a plurality of abrasive pads mounted on a support. The abrasive pads comprise a mass of discrete abrasive particles uniformly dispersed in a bonding matrix. The pads are in the form of strips.

SUMMARY OF THE INVENTION

According to the present invention, there is provided a polishing tool component, comprising a carrier and a plurality of spaced abrasive elements located in the carrier, each abrasive element presenting an abrasive working surface having a perimeter which is circular, polygonal or like non-elongate shape and comprising a mass of abrasive particles uniformly dispersed in a bonding matrix, the abrasive working surfaces of the elements together defining a working surface for the component.

BRIEF DESCRIPTION OF THE DRAWINGS

FIG. 1 is a perspective view of an embodiment of a polishing pad of the invention;

FIG. 2 is a section along the line 2—2 of FIG. 1;

DESCRIPTION OF EMBODIMENTS

Figure 3:
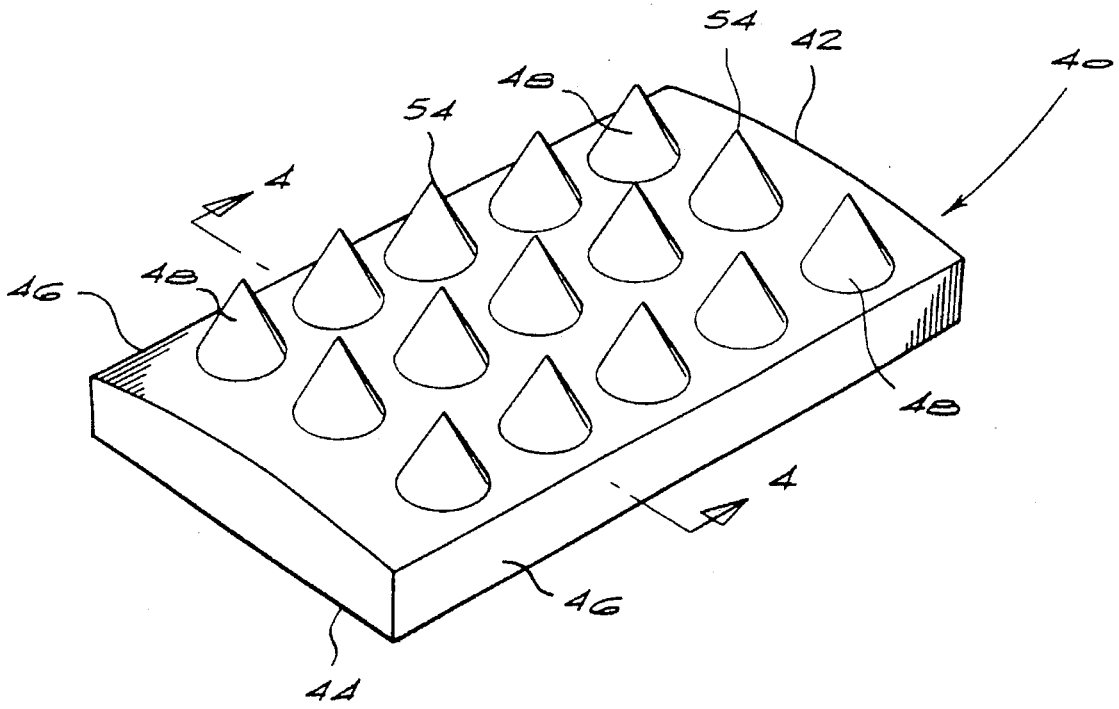
FIG. 3 is a perspective view of a carrier of a second embodiment of the invention.

The polishing tool component of the invention may be one suitable for various polishing tools such as revolving tools, revolving pendulum action tools and planetary polishing tools. The shape of the component may be any known in the art such as rectangular, as is generally used with revolving and revolving pendulum action tools, or disc-shaped, as is generally used with planetary polishing tools.

The carrier will generally present a surface in which the abrasive elements are located. The working surfaces of the elements may be located in this surface or they may project beyond this surface. When the working surfaces project beyond the carrier surface in which they are located, they may include at least one peak. This peak may provide a sharp point, e.g. it may be cone-shaped. Such peaks, when provided, will generally each have the same height from the carrier surface in which the elements are located.

The perimeter of the working surfaces may be circular, square or rectangular. The working surface may cover the entire area within the perimeter or may cover a portion of the area only, e.g. be ring-shaped.

The abrasive working surfaces of the elements together define an abrasive working or polishing surface for the component. To achieve this it is preferable that the abrasive elements are uniformly distributed across the carrier. The elements may, for example, be arranged in rows such that the working surfaces of the elements in one row are staggered relative to the working surfaces of the elements in an adjacent row. Alternatively, the elements may be arranged in rows such that the working surfaces of the elements in one row are in register with the working surfaces of the elements in an adjacent row.

The abrasive particles will preferably be ultra-hard abrasive particles such as diamond or cubic boron nitride. These particles will typically have a particle size of up to 500 microns and be present in an amount of up to 30 percent by volume.

The bonding matrix may be metal, ceramic or resin. When it is resin it is preferably a non-porous thermoplastic polymer, which may contain fibrous or particulate filling materials. Examples of suitable thermoplastic polymers are:

- Poly etheretherketone (PEEK) and polyetherketone (PEK) such as that marketed by ICI under the trade name VICTREX®.
- Polyaryletherketone such as that marketed by BASF under the trade name ULTRAPEK®.
- Poly (amide-imide) such as that marketed by Amoco under the trade name TORLON®.
- Polyphenyl sulphide (PPS) such as that marketed by Phillips under the trade name RYTON®.
- Liquid Crystal Polymer (LCP) such as that marketed by Hoechst under the trade name VECTRA®.

Examples of suitable metal bonding matrices are bronze and cobalt-bronze.

The carrier may be rigid or flexible. It may be made of a metal such as steel or a polymer which may be thermosetting or thermoplastic. Examples of suitable thermosetting polymers are phenolic and polyurethane. Examples of suitable thermoplastic polymers are acrylonitrile butadiene styrene and polypropylene.

Two embodiments of the invention will now be described with reference to the accompanying drawings. Referring first to FIGS. 1 and 2, there is shown a polishing pad comprising a carrier 10 having a major curved surface 12 and an opposite major flat surface 14. The two major surfaces 12, 14 are joined by sides 16. The carrier is joined to a base 18 along its lower major surface 14. The base 18 and carrier 10 are held joined to each other by means of pins 20 protruding upwardly from the surface 22 of base 18 and which engage complemental recesses 24 formed in the surface 14. The base 18 is shaped for mounting on a suitable polishing head. The base 18 and the carrier 10 may constitute an integral unit for mounting on to a suitable polishing head.

The polishing pad has a plurality of abrasive elements 26 located in it. The elements 26 are discrete and spaced from one another. The elements 26 extend from the curved surface 12 into the carrier. Each element comprises a ring 28 consisting of a mass of abrasive particles uniformly dispersed in a bonding matrix. Each ring 28 has a truncated cone shape tapering from a base 30 to a polishing surface 32. The polishing surface 32 of each element is located in the curved surface 12 of the carrier. The polishing surfaces 32 together form an abrasive polishing surface for the pad. It will be noted that the elements are located in the carrier in a series of rows wherein the elements of one row are staggered relative to the elements in an adjacent row. This arrangement ensures that the polishing surfaces 32 together define a polishing surface for the pad which effectively covers the curved surface 12 of the carrier.

It will be noted that the abrasive rings 28 are circular in cross-section. They can have other shapes in cross-section such as square, rectangular, triangular, pyramidal, oval or elliptical.

The cone-shape of the abrasive elements has the advantage that the tendency for the abrasive elements to be pulled out of the carrier in use is minimised.

In one preferred form of the invention, the abrasive rings comprise a mass of diamond particles dispersed in a bonding matrix. The carrier 12 is manufactured by placing the abrasive rings in a desired pattern on a surface of a mould and thereafter introducing a resin into the mould. The resin will flow around the elements and into the hollow in each ring. On setting of the resin, the component is produced. The resin may be injected into the mould.

In an alternative embodiment (not illustrated) instead of the pin/recess means of joining the carrier to the base, a countersunk screw can be provided in one of the components which engages a threaded hole in the other component.

Figure 4:
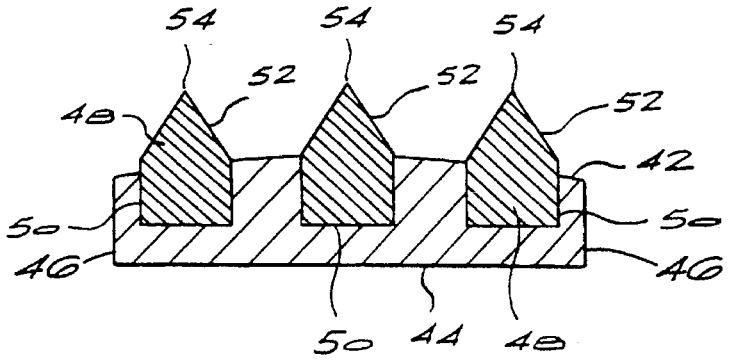
FIG. 4 is a section along the line 4—4 of FIG. 3.

A second embodiment of the invention is illustrated by FIGS. 3 and 4. Referring to these figures, a carrier 40 for a polishing pad has a major curved surface 42 and an opposite major flat surface 44. The two major surfaces 42, 44 are joined by sides 46. The carrier 40 may be joined to a base (not shown) in a similar manner to that of the embodiment of FIGS. 1 and 2.

The polishing pad 40 has a plurality of abrasive elements 48 located in it. The elements 48 are located in recesses 50 formed in the curved surface 42 of carrier 40. Each element 48 consists of a mass of abrasive particles uniformly dispersed in a bonding matrix. The elements are right-circular cylindrical in shape and have a cone-shaped working surface 52 which projects beyond the curved surface 42 of the carrier. The apex 54 of each cone provides a point. The height of the apices 54 from the curved surface 42 is the same. It will be noted that in this embodiment the elements 48 are located in the carrier in a series of rows wherein the elements 48 of one row are in register with the elements 48 in an adjacent row.

In this embodiment the cone-shaped working surfaces 52 together define a polishing surface for the pad. In use, it is the peaks or apices 54 which first contact the workpiece. The points will wear quickly, thus allowing effective contact between the workpiece and the remainder of the cone-shaped abrasive working surfaces. Any mis-alignment in the polishing pad is thus quickly accommodated facilitating early bedding in of the abrasive elements. Efficient and rapid polishing occurs.

It has been found the cone-shaped working surfaces 52 which have an included angle in the apices of greater than 90° achieve excellent polishing efficiencies.

We claim:

1. A polishing tool component comprising a carrier and a plurality of spaced discrete abrasive elements located in the carrier, each abrasive element being discrete from the carrier and comprising a cylindrical or cone-shaped body, one end of which is located in a surface of the carrier and the other end of which presents an abrasive working surface which projects beyond the surface of the carrier, wherein the abrasive working surfaces of the abrasive elements together define a working surface for the polishing tool component, and each abrasive element comprises a mass of abrasive particles uniformly dispersed in a bonding matrix, wherein the abrasive particles have a size of up to 500 microns, and are present in the working surface in an amount of up to 30 percent by volume.

2. A component according to claim 1, wherein each abrasive element defines at least one peak and the peaks of the plurality of spaced abrasive elements are at the same height relative to the surface of the carrier in which the abrasive elements are located.

3. A component according to claim 1, wherein the abrasive elements are arranged in rows wherein the working surfaces of the elements in one row are staggered relative to the working surfaces of the elements in an adjacent row.

4. A component according to claim 1, wherein the abrasive elements are arranged in aligned rows having an equal number of abrasive elements in each row and also in aligned columns having an equal number of abrasive elements in each column.

5. A component according to claim 1, wherein each element defines a perimeter and the working surface of each element covers the entire area within the perimeter.

6. A component according to claim 1, wherein each element defines a perimeter and the working surface of each element covers only a part of the area within the perimeter.

7. A component according to claim 6, wherein the working surface of each element has the shape of a ring.

8. A component according to claim 1, wherein the abrasive particles are ultra-hard abrasive particles.

9. A component according to claim 8, wherein the ultra-hard abrasive particles are diamond.

10. A component according to claim 8, wherein the ultra-hard abrasive particles are cubic boron nitride.

11. A component according to claim 1, wherein the bonding matrix comprises a metal.

12. A component according to claim 1, wherein the bonding matrix comprises a ceramic.

13. A component according to claim 1, wherein the bonding matrix comprises a resin.

14. A component according to claim 1, wherein the bonding matrix comprises a non-porous thermoplastic polymer.

15. A component according to claim 1, wherein each abrasive element is comprised entirely of a mass of abrasive particles uniformly dispersed in a bonding matrix.

* * * * *